United States Patent [19]

Gieck

[11] 4,052,138

[45] Oct. 4, 1977

[54] METHOD OF FIRING COAL BOILER TO PRODUCE SECONDARY FUEL GAS

[76] Inventor: Joseph F. Gieck, 645 W. 59th Terrace, Kansas City, Mo. 64113

[21] Appl. No.: 664,563

[22] Filed: Mar. 8, 1976

[51] Int. Cl.[2] ..... F23L 7/00

[52] U.S. Cl. ..... 431/4; 110/1 P; 431/10

[58] Field of Search ..... 431/2, 3, 4, 10; 110/1 P, 1 K

[56] References Cited

U.S. PATENT DOCUMENTS

| | | | |
|---|---|---|---|
| 3,727,562 | 4/1973 | Bauer | 431/10 |
| 3,733,165 | 5/1973 | Nakagawa et al. | 431/10 |

FOREIGN PATENT DOCUMENTS

| | | | |
|---|---|---|---|
| 824,8 83 | 12/1959 | United Kingdom | 110/1 K |

*Primary Examiner*—Edward G. Favors
*Attorney, Agent, or Firm*—John A. Hamilton

[57] ABSTRACT

A method of firing coal-powered boilers to produce both heat to operate the boiler at its full rated capacity, and also to produce a usable fuel gas generally equal in heat content to the heat consumed in the boiler to produce steam, said method consisting of burning pulverized coal in the presence of varying proportions of steam and oxygen. The boiler is over-fired with coal, but with an undersupply of oxygen, in order that the total available heat content of the coal is divided between heat released by the incomplete combustion thereof, which may be sufficient to operate the boiler at full steam capacity, and heat content contained in combustible flue gases, which may be utilized for many different purposes.

5 Claims, 1 Drawing Figure

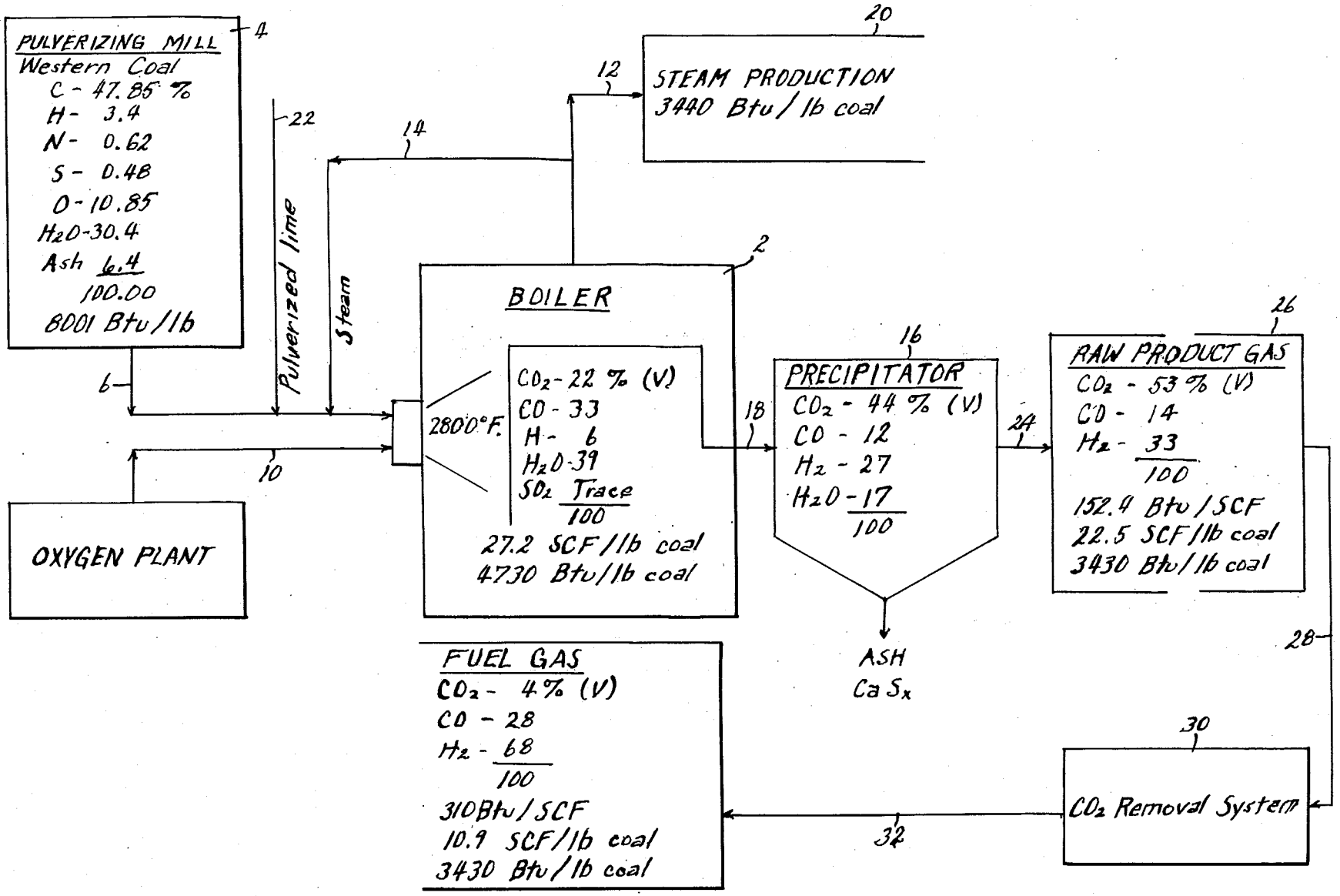
PULVERIZING MILL
Western Coal
C - 47.85 %
H - 3.4
N - 0.62
S - 0.48
O - 10.85
H2O - 30.4
Ash 6.4
100.00
8001 Btu/lb
4
6
Pulverized lime
22
Steam
14
10
OXYGEN PLANT
2800°F.
BOILER
CO2 - 22 % (V)
CO - 33
H - 6
H2O - 39
SO2 Trace
100
27.2 SCF/lb coal
4730 Btu/lb coal
2
18
12
STEAM PRODUCTION
3440 Btu/lb coal
20
PRECIPITATOR
CO2 - 44 % (V)
CO - 12
H2 - 27
H2O - 17
100
16
ASH
Ca Sx
24
RAW PRODUCT GAS
CO2 - 53 % (V)
CO - 14
H2 - 33
100
152.4 Btu/SCF
22.5 SCF/lb coal
3430 Btu/lb coal
26
28
CO2 Removal System
30
32
FUEL GAS
CO2 - 4% (V)
CO - 28
H2 - 68
100
310 Btu/SCF
10.9 SCF/lb coal
3430 Btu/lb coal

METHOD OF FIRING COAL BOILER TO PRODUCE SECONDARY FUEL GAS

This invention relates to new and useful improvements in methods for firing ordinary waterwall boilers, and has as its primary object the provision of a firing method whereby the boiler not only may be operated at full rated capacity, but which also produces a combustible fuel gas which may be utilized for many different purposes. For example, it may be used to fire a gas powered boiler, which may be of equal or even greater capacity than the coal boiler, or may be used to supply processes ordinarily using natural gas as a fuel. The operators of many such process apparatuses are faced with the necessity of converting to the use of solid fuels such as coal, which is relatively plentiful, in view of the present and projected shortage of natural gas, and in many cases such conversions are virtually prohibitively expensive. Most broadly stated, this general object is accomplished by burning the boiler coal in the presence of insufficient oxygen to allow full normal combustion thereof, so that only a portion of its total heat content is released for the normal use of converting water to steam, while the remainder of the total available heat content of the coal passes through the boiler as available chemical energy in the flue gases, said gases being combustible as a fuel gas. The boiler may be fired with an excess of coal, so that the proportion of its heat content released by the partial combustion may still be sufficient to allow the boiler to produce its full rated capacity of steam.

Another object is the provision of a method of the general character described in which the coal is pulverized, and is burned in the presence of varying proportions of steam and oxygen, but not air. Pulverization of the coal has the usual advantage of providing more efficient combustion. The use of oxygen rather than air also promotes more efficient combustion, and additionally eliminates nitrogen, of course present in large quantities in air, from the system. This reduces the total flue gas volume produced in the process, nitrogen being substantially inert and useless for heat producing purposes, and thus it is possible to practice the process without increasing the size of the boiler fire box over that required in normal firing of the boiler. The introduction of steam has at least two important functions. First, it lowers the boiler temperature to a manageable range, perhaps about 2500° 1 F., as compared to 3°–4,000° F. if the coal were burned in the presence of pure oxygen only. Second, it introduces hydrogen, which is converted to gaseous form usable as a fuel gas in a water-gas shift reaction which occurs as the gaseous products of combustion are cooled by extraction of heat therefrom to convert boiler water to steam.

A further object is the provision of a method of the general character described which is clean and non-polluting to the atmosphere to the extent that, with certain adjuncts such as ash and suphur removal, it may be conducted without a smokestack in normal operation, although a stack may be required for starting and/or emergencies.

Other objects are simplicity and economy as to equipment required, pre-existing equipment be usable in most instances, and efficiency and dependability of operation.

With these objects in view, as well as other objects which will appear in the course of the specification, reference will be had to the accompanying drawing, wherein the single figure is a flow chart diagram of a boiler firing method embodying the present invention.

Using a typical Western sub-bituminous coal as an example, its analysis as mined would be approximately:

| | % by weight | Calorific value |
|---|---|---|
| Carbon | 47.85 | 8001 Btu/lb. |
| Hydrogen | 3.40 | |
| Nitrogen | 0.62 | |
| Sulfur | 0.48 | |
| Oxygen | 10.85 | |
| Water | 30.40 | |
| Ash | 6.40 | |
| | 100.00 | |

In the usual method of firing a boiler with this coal, a simplified combustion reaction using 20° excess air would be as follows:

$$C + 0.25\ H_2 + 1.35\ O_2 + 5.11\ N_2 \rightarrow CO_2 + 0.225\ O_2 + 0.25\ H_2O + 5.11\ N_2$$

Heat of Combustion = 8001 Btu/lb coal

Volume of Flue Gas = 103 Standard Cubic Feet/lb coal

In the method contemplated by the present invention, however, the coal is burned in the presence of a mixture of $O_2$ and steam, but not air, in variable proportions. Selecting proportions calculated to produce a substantially equal division between available heat released in the boiler and the heat content of the flue gases, the mixture is about 55% oxygen and 45% steam, by volume. The typical combustion reaction equation would then be:

$$C + 0.25\ H_2 + 0.75\ O_2 + 0.6\ H_2O \rightarrow 0.4\ CO_2 + 0.6\ CO + 0.7\ H_2O + 0.1\ H_2$$

Flame temperature = 2800° F.

heat of combustion = 4730 Btu/lb coal

It will be noted that only about approximately one-half of the previously used amount of oxygen, in relation to the amount of coal used, is supplied in this method, as reflected by the decreased production of $CO_2$ and increased production of combustible CO. The same fact is also indicated by a decrease in the heat released by combustion, amounting only to about 4730 Btu/lb coal. However, the CO is then available as a fuel gas, and may be burned for any useful purpose, and the amount of coal fed to the boiler may be approximately doubled, in order that the reduced proportion of its total enthalpy released by combustion may still be sufficient to operate the boiler, in its primary function of producing steam, at full rated capacity.

It will be seen that further while the rate of coal supply to the boiler must be approximately doubled in the present method, as compared to the usual excess-air firing, the actual $O_2$ requirement is only about one-half of that required in air firing, per pound of coal, so that the total $O_2$ requirement is not materially increased. Also, the flue gas production in the present method, per pound of coal, is greatly reduced, being only 27.2 SCF/lb coal, rather than 103 SCF/lb coal as in air firing. Thus the total flue gas production volume is not increased, but is in fact decreased, so that the firebox volume of a common boiler designed for excess-air firing need not be increased to perform the present method, and indeed could be reduced.

The drawing shows the boiler 2, to which the coal is fed in pulverized form from a pulverizing will 4, as indicated at 6. Also fed to the boiler, so that the coal is burned in the presence thereof, is oxygen from a suitable oxygen producing plant 8, the $O_2$ conduit being indicated at 10. The steam produced by the boiler passes through a conduit 12 for utilization in any desired manner. A portion of this steam is returned by conduit 14 to be delivered to the burner together with the pulverized coal and oxygen. The introduction of steam into the combustion reaction has two important function as relates to the present method.

Firstly, the steam reduces the boiler temperature to a manageable level of about 2500° F., so that a standard waterwall boiler may be used. If the coal were burned in the presence of $O_2$ only, the boiler temperature would be perhaps 3°–4000° F., and would require special equipment.

Secondly, the steam provides a source of hydrogen, which is of course combustible and increases the total heat content of the flue gases produced. As will be seen from the basic combustion reaction as given above, the steam introduced is still largely in the form of steam immediately after combustion has occured, but as the products of combustion are then cooled by the extraction of heat therefrom to generate steam, a "water-gas shift" reaction occurs in which some of the hydrogen content of the steam is converted to free hydrogen. The amount of hydrogen converted depends on equilibrium conditions at any given temperature, but for all practical purposes the shift is completed when the gases have cooled to about 900° F., since very little $H_2$ production occurs below that temperature. At about 900° F., the typical water-gas shift reaction which will have occurred is as follows:

$$0.4\ CO_2 + 0.6\ CO_2 + 0.7\ H_2O = 0.1\ H_2 - 0.79\ CO_2 + 0.21\ CO + 0.31\ H_2O + 0.49\ H_2$$

The analysis of the gases at this time is indicated at the ash precipitator 16 of the system, which receives the products of combustion from the boiler through conduit 18. It will be noted that the $H_2$ content of the gases has risen from 6to 27%, and the water (steam) content reduced from 39 to 17%, as compared to the original gaseous products of combustion. The water-gas shift reaction is endothermic, absorbing a portion of the heat of combustion, thus the usable proportion of the original heat of combustion of the coal, which amounted to 4730 Btu/lb coal, is calculated to be reduced to about 3440 Btu/lb coal, as indicated at 20 on the flow chart. In this connection it should be noted that while the exemplary coal used contains 30.4% $H_2O$, this moisture is still not sufficient to obtain maximum hydrogen production from the water-gas shift reaction, so that the addition of additional moisture in the form of steam is required. Moreover, the coal analysis given is "as mined" and in fact has often dried to as little as 3% moisture by the time it is actually fired, so that more steam is required. However, any moisture present in the coal as fired does enter into the water-gas shift reaction, and affects the amount of additional steam required.

Since the amount of coal being fired has been about doubled, the amount of ash to be removed is also doubled. This need not be a problem, however, since the ash may still be removed by precipitator 16, or other well known means not pertinent to the present invention. Also, if pulverized lime or other basic salt is added to the coal fed to the boiler, as indicated at 22, it will drag down some of the sulfur to ash as solid components, such as $CaSO_4$, $CaSO_3$, CaS, etc.

Gases leaving precipitator 16 through conduit 24 constitute the raw product gas of the present method, having the analysis shown at 26 in the chart, and a total heat content of about 3430 Btu/lb coal, almost precisely equal to the heat released to steam in the boiler. The combustible constituents of this gas are CO, produced by the incomplete combustion of the coal resulting from the deficient supply of oxygen to the combustion, and $H_2$, produced from the water-gas shift reaction, the greater proportion of the heat content being contained by the hydrogen. This product gas may be utilized as a fuel gas or in the production of fuel oils.

The heat conversion efficiency of the process is very high:

| | |
|---|---|
| Heat to steam | = 3440 Btu/lb coal |
| Heat of combustion of Flue Gas | $= \frac{3430}{6870}$ Btu/lb coal |
| Less Heat of Steam Returned to Boiler Feed | − 450 |
| Net Heat Converted | = 6420 Btu/lb coal |
| Thermal Efficiency | $= \frac{6420}{8001} = 80.2\%$ |

Of course, the raw product gas is more than half $CO_2$, by volume, this carbon dioxide being incombustible. Therefore, it may be desirable to transport it through a conduit 28 to a $CO_2$ removal station 30, wherein all or most of the $CO_2$ may be removed by any suitable process, well known in the art but not in itself pertinent to the present invention, thereby producing a fuel gas through conduit 32 containing, by example, 28% CO and 68% $H_2$, with only 4% $CO_2$. This step of the process of course does not increase the total heat content of the gas, but merely concentrates it and reduces its volume. Furthermore, the $CO_2$ removed at 30 has commercial value in many applications. The CO and $H_2$ may be separated in further steps, if desired, again by known methods and apparatus in themselves forming no part of the present invention. Here again the total heat content of the gases is not increased, but the separation may be desirable for specific applications.

While the example stated above has been selected to provide release of substantially equal amounts of heat to steam in the boiler and to heat content of the flue gases, it is possible, by varying the quantity and proportions of the oxygen and steam fed to the boiler, to release as little as 30% or as much as 70% of the converted heat to steam in the boiler, and as much as 70% or as little as 30% of said heat as heat content of the flue gases, as may be desired. It is also possible to use "oxygen-enriched" air in place of pure oxygen, as long as the proportions therof used, as related to the coal and steam used, are properly adjusted.

The usual pollution problems connected with conventionally fired boilers are completely eliminated by the present process of firing. Using oxygen instead of air eliminates all nitrogen from the system, and eliminates any possibility of various nitrous oxide compounds, generally designated NOx.

While I have shown and described a specific example of my invention, it will be readily apparent that many minor changes in the details thereof could be made without departing from the spirit of the invention.

What I claim as new and desire to protect by Letters Patent is:

1. A method of firing a coal-fired boiler as used in the production of steam comprising:

a. introducing coal in pulverized form into the firebox of said boiler in an amount greater than would be required to enable said boiler to produce steam at its rated capacity if an amount of oxygen were introduced sufficient to produce full combustion of said coal, and b. introducing oxygen into said firebox, and burning said coal in the presence thereof, in quantities insufficient to produce full combustion of said coal, whereby the proportion of the total heat content of said coal released as heat by the resulting partial combustion of said coal is reduced, and the gaseous products of said partial combustion contain quantities of carbon monoxide which are combustible and may be utilized as fuel gas, and selecting proper coal-oxygen proportions, such that the amount of heat released by said partial combustion is sufficient to enable the boiler to produce steam at its rated capacity while still producing gases containing useful quantities of combustible carbon monoxide.

2. A method as recited in claim 1 wherein said oxygen is introduced into the firebox of said boiler in the form of substantially pure $O_2$, rather than as a constitutent of air, whereby nitrogen is eliminated from the flue gas system to reduce the air polluting qualities of said flue gas by eliminating any possibility of NOx formation, and whereby the volume of the flue gases produced is reduced as compared to that produced in normal excess-air firing of an amount of coal to produce the same amount of heat produced by the partial combustion, and whereby, by proper selection of the coal-oxygen proportions, the volume of flue gases produced need not be increased over that produced in normal excess-air firing of the boiler, so that the size of the boiler firebox need not be increased over that required for normal excess-air firing.

3. A method as recited in claim 2 with the additional step of introducing steam into said boiler firebox in combination with said coal and said $O_2$, whereby a portion of the hydrogen content of said steam is converted to gaseous form as the initial gaseous products of boiler combustion are cooled by the extraction of heat therefrom to generate boiler steam, by means of a water-gas shift reaction occurring as said cooling progresses, said gaseous hydrogen being a combustible fuel gas coexisting with the carbon monoxide content of the flue gases to add to the total heat content of said flue gases.

4. A method as recited in claim 3 wherein oxygen is used in an amount equal to about one-half of the amount required to produce full combustion of the coal, and wherein said oxygen and steam are added in proportions, by volume, of 55% oxygen and 45% steam, whereupon the amount of heat released in the boiler for generating steam will be approximately equal to the heat content of the flue gases.

5. A method as recited in claim 3 wherein a portion of the steam generated by said boiler is returned to the boiler firebox to supply steam for said water-gas shift reaction, the loss of externally available steam occasioned by this partial recycling being much less than the heat content added to the flue gases by the water-gas shift.

* * * * *